US005839583A

United States Patent [19]

Pope et al.

[11] Patent Number: 5,839,583

[45] Date of Patent: Nov. 24, 1998

[54] PACKAGING

[75] Inventors: Peter Pope, Balcombe; Michael Pearse, East Grinstead; Martin Marshall, Huntington; Richard Edward Pytches, Farndon, all of England

[73] Assignee: Duracell Batteries, Ltd., Crawley, United Kingdom

[21] Appl. No.: 882,654

[22] Filed: Jun. 25, 1997

[51] Int. Cl.[6] ..... B65D 73/02

[52] U.S. Cl. ..... 206/704; 53/473; 206/460

[58] Field of Search ..... 53/397, 443, 448, 53/468, 471, 473; 206/460, 539, 703, 704, 705

[56] References Cited

U.S. PATENT DOCUMENTS

| | | | |
|---|---|---|---|
| 2,834,456 | 5/1958 | Langer | 206/531 |
| 3,069,273 | 12/1962 | Wayne | 53/471 |
| 4,015,708 | 4/1977 | Kelm | 206/704 |
| 4,209,091 | 6/1980 | Lieberman | 206/704 |
| 5,033,616 | 7/1991 | Wyser | 206/704 |
| 5,203,455 | 4/1993 | Hewelt et al. | 206/333 |

FOREIGN PATENT DOCUMENTS

| | | |
|---|---|---|
| 0529199 | 5/1995 | European Pat. Off. . |

*Primary Examiner*—Jim Foster
*Attorney, Agent, or Firm*—Barry D. Josephs; Paul I. Douglas

[57] ABSTRACT

A package for articles such as zinc air batteries includes a base, a cover hinged to the base, and a flexible sheet material for covering the articles. The base includes pockets for the articles. The flexible sheet material adhesively attached to the articles and base, covers the articles in the pockets. The articles are capable of being stripped from the flexible sheet material.

7 Claims, 3 Drawing Sheets

PACKAGING

This invention is concerned with packaging. It is sometimes desirable to package several articles individually within a common pack to enable the consumer to remove the articles in turn for use. The invention relates in particular to the packaging of small batteries as may be used to power personal appliances such as hearing aids. In the case of appliances, like hearing aids, which tend to be used continuously, battery life is relatively short and users generally wish to carry spare batteries with them and to purchase batteries several at a time, for example in packs of four or six batteries. It is known, therefore, to package batteries in groups of 4 or 6 in plastic cases for sale to customers. A type of small battery well suited to appliances such as hearing aids is a zinc air battery. A zinc air battery includes a small air hole in its metal casing and the air hole must be exposed for the battery to function. However, even if the battery is not being used to power an appliance, it can loose its power, typically in about three months, if the air hole is exposed. For this reason it is necessary for the air hole to be sealed closed from the time of manufacture of the battery until it is to be fitted into an appliance. A technique which has been used for the packaging of DURACELL ACTIVAIR zinc air batteries is to cover the air hole by applying an adhesive plastics disc to the battery, this disc having a tab portion which protrudes beyond the edge of the battery for ease of grasping the disc for removal from the battery when the battery is required for use. The known DURACELL ACTIVAIR battery package, which hold e.g. 4 or 6, batteries equipped with their individual sealing discs, comprises a plastics container including a base formed with pockets to receive and retain the respective batteries, and a cover hinged to the base for movement between a closed position in which the cover and base form an enclosure enclosing the batteries, and an open position providing access to the enclosed batteries for removal of individual batteries. Whilst these battery packages are quite convenient for consumers, they are not without drawbacks from a manufacturing viewpoint. Batteries with the sealing discs applied thereto make automated filing of the containers difficult to achieve and as a consequence it has been the practice to load the batteries into the pockets of the container base manually, which is inefficient.

The present invention addresses the foregoing drawback and as a solution it proposes a package comprising a base with a plurality of pockets, respective articles being received in the pockets, and a unitary element of flexible sheet material including a spine portion adhered to the base, and an article covering portions connected to the spine portion and extending over respective pockets, the covering portions being adhesively connected to the articles received in the pockets.

Where the articles are batteries, in particular zinc air batteries, the covering portions will cover and seal closed the air holes of the batteries until they are required for use. As the unitary sheet material element is adhesively attached to the base, it can assist in retaining the batteries in their pockets, which means that the pockets themselves are not solely responsible for keeping the batteries in place and, therefore, need not grip the batteries firmly, thereby allowing the pockets to be formed to broader manufacturing tolerances and possibly enabling easier removal of individual batteries from their pockets. When a battery is required for use, it is lifted from its pocket, the flexibility of the sheet element permitting such removal, and the battery is peeled away from the covering portion to which it is adhesively attached. To assist the battery removal the covering portions of the sheet element preferably include tabs which project in a direction away from the spine portion. By holding a tab in the fingers and pulling it away from the base, the associated covering portion will be deflected and lift the battery adhered thereto from its pocket.

The use of a unitary element of flexible sheet material to cover the batteries facilitates automation of the packaging process since such an element can be applied by a conventional labelling machine after the batteries have been loaded into the pockets, which in turn means that the batteries can be simultaneously loaded into the pockets by means of an automated filling machine.

Thus, in accordance with a second aspect the invention resides in a method of packaging articles comprising the steps of:

(i) providing a base having a plurality of separate pockets for accommodating respective articles;

(ii) loading articles into the pockets by means of an automated filling machine; and (iii) applying a unitary element of flexible sheet material over the base and the articles loading into the pockets by means of an automated labelling machine, the element including a portion adhesively attached to the base, and article covering portions adhesively attached to the respective articles.

Most conveniently the flexible sheet elements are supplied to the labelling machine in the form of a strip with a series of elements carried on a backing web.

A more detailed description of the invention will now be given with reference to the accompanying drawings, in which.

Figure 2:
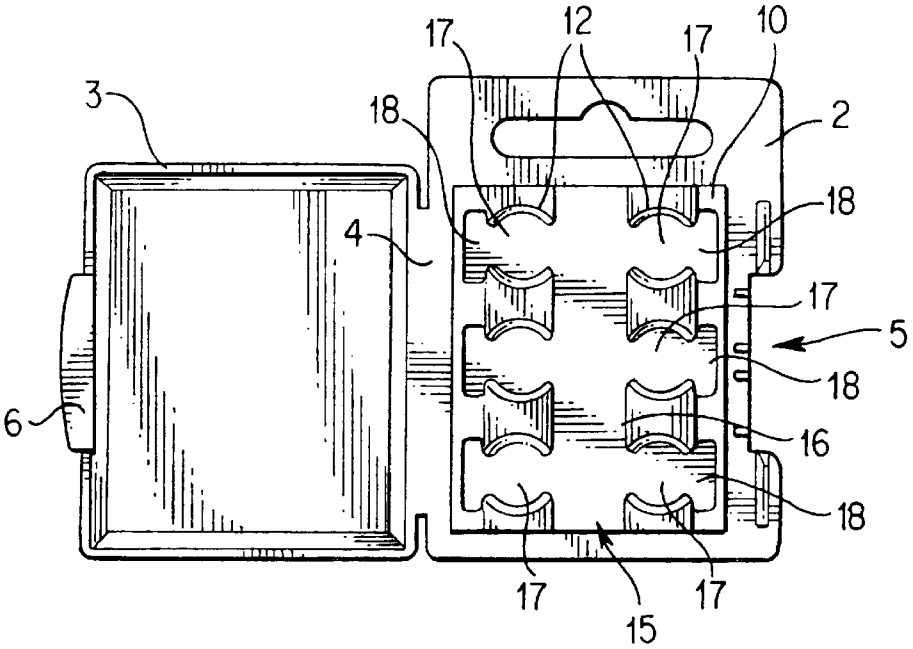
FIG. 2 shows the package of FIG. 1 in an open condition and in front elevation.
Figure 3:
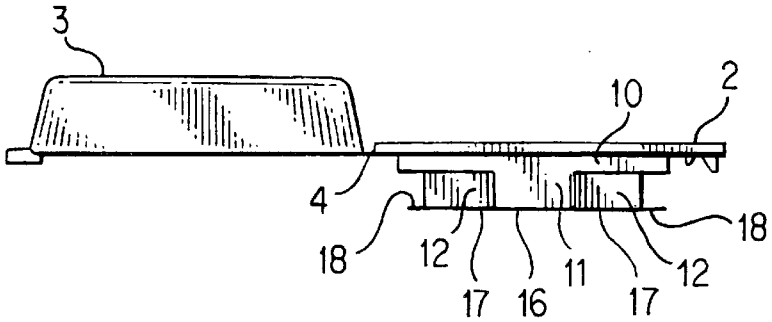
FIGS. 3 and 4 show the package of FIG. 2 in plan and side elevation, respectively.
Figure 1:
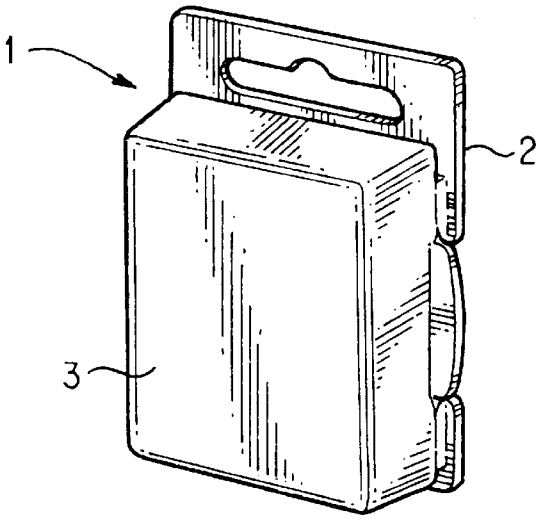
FIG. 1 shows in perspective a zinc air battery package embodying the invention the package being shown in a closed condition.
Figure 4:
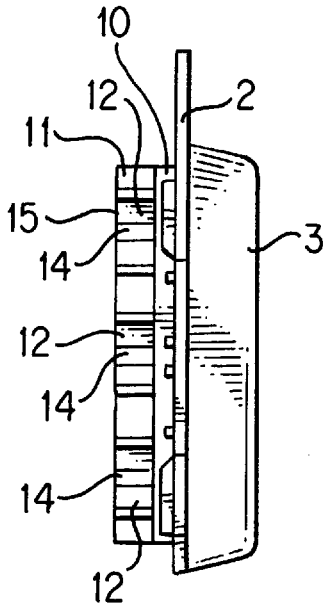
Figure 5:
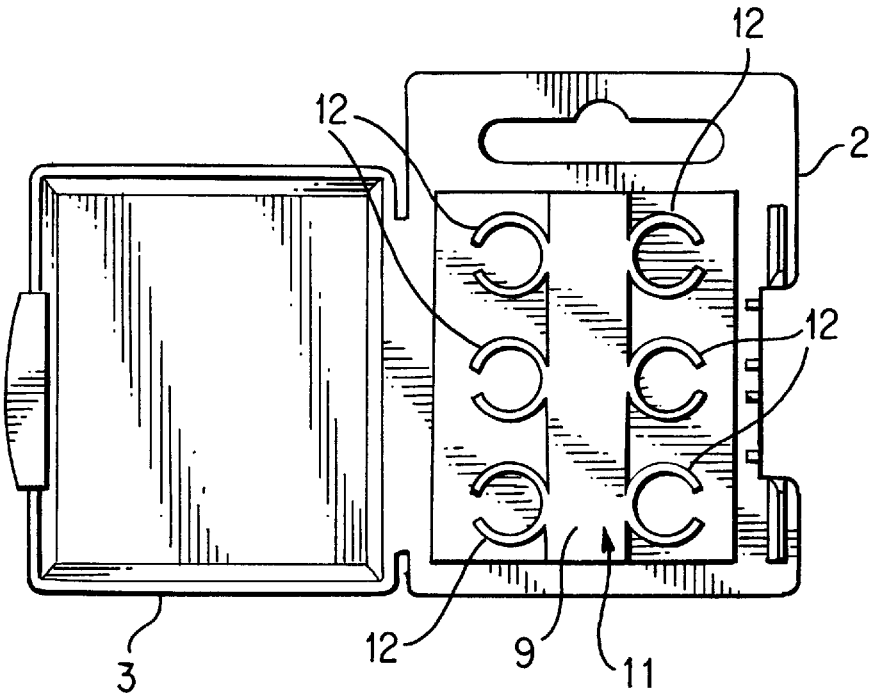
FIG. 5 is a front elevation of the container base before the pockets are filled with batteries.

The zinc air battery package illustrated in the drawing includes a plastics container 1 moulded in one piece and including a base 2 and a cover 3 connected to the base by an integral hinge 4 to allow the cover to move between the closed and open positions shown in FIGS. 1 and 2 respectively. To maintain the cover in the closed condition complementary snap-catch formations 5,6 are provided at the edges of the base and cover remote from the hinge 4. The container base 2 is formed on its inner or upper side with a slightly raised platform or plinth 10 on which is an upstanding longitudinal rail 11 defining a substantially flat upper surface 9 (FIG. 5). On either side of the rail 11 there are formed pockets 12 (FIG. 5) in which respective zinc air batteries 14 are accommodated. As shown there are a total of six pockets arranged in three pairs, the pockets 12 of each pair being laterally opposed with respect to the rail 11. The batteries 14 are conventional and cylindrical in shape. When inserted into the pockets 12 the upper flat faces of the batteries, these being the faces in which the air holes are provided, lie substantially coplanar with the upper surface of the rail 11. Applied over the base 2 and the batteries 14 accommodated in the pockets is a unitary element 15 of flexible plastics sheet material. The element includes a spine portion 16 which overlies and is adhesively connected to the upper surface 9 of the rail 11. Extending from the spine portion are six covering portions 17 disposed to overly the respective pockets 12 and the batteries 14 received therein. These covering portions 17 are adhesively attached to the respective underlying batteries 14. Each covering portion has a tab 18 projecting in a direction opposite the spine portion 16 beyond the edge of the associated battery 14 and the pocket 12 in which it is received. Although the material of the sheet element 15 is flexible it has sufficient stiffness to maintain the substantially flat condition in which it is applied over container base 2 and batteries 14, and hence the sheet element 15 assists in retaining the batteries on the base in spite of the batteries having a loose fit in the pockets. When an individual battery is required for use, the tab 18 of the covering portion 17 to which the battery is attached is manually grasped, e.g. between the thumb and forefinger and moved away from the base 2, whereby the battery 14 is lifted out of its pocket 12, the element 15 naturally bending at the join between the spine and covering portions 16,17. The battery is then peeled away from the covering portion 17, the adhesive allowing this to be achieved without undue difficulty.

It will be appreciated that modifications can be made to the described package without departing from the inventive principles. In particular the shape and size of the pockets can be varied to suit the particular batteries to be packaged. Of course, the number of pockets will be chosen according to the number of batteries to be included in the package.

Figure 6:
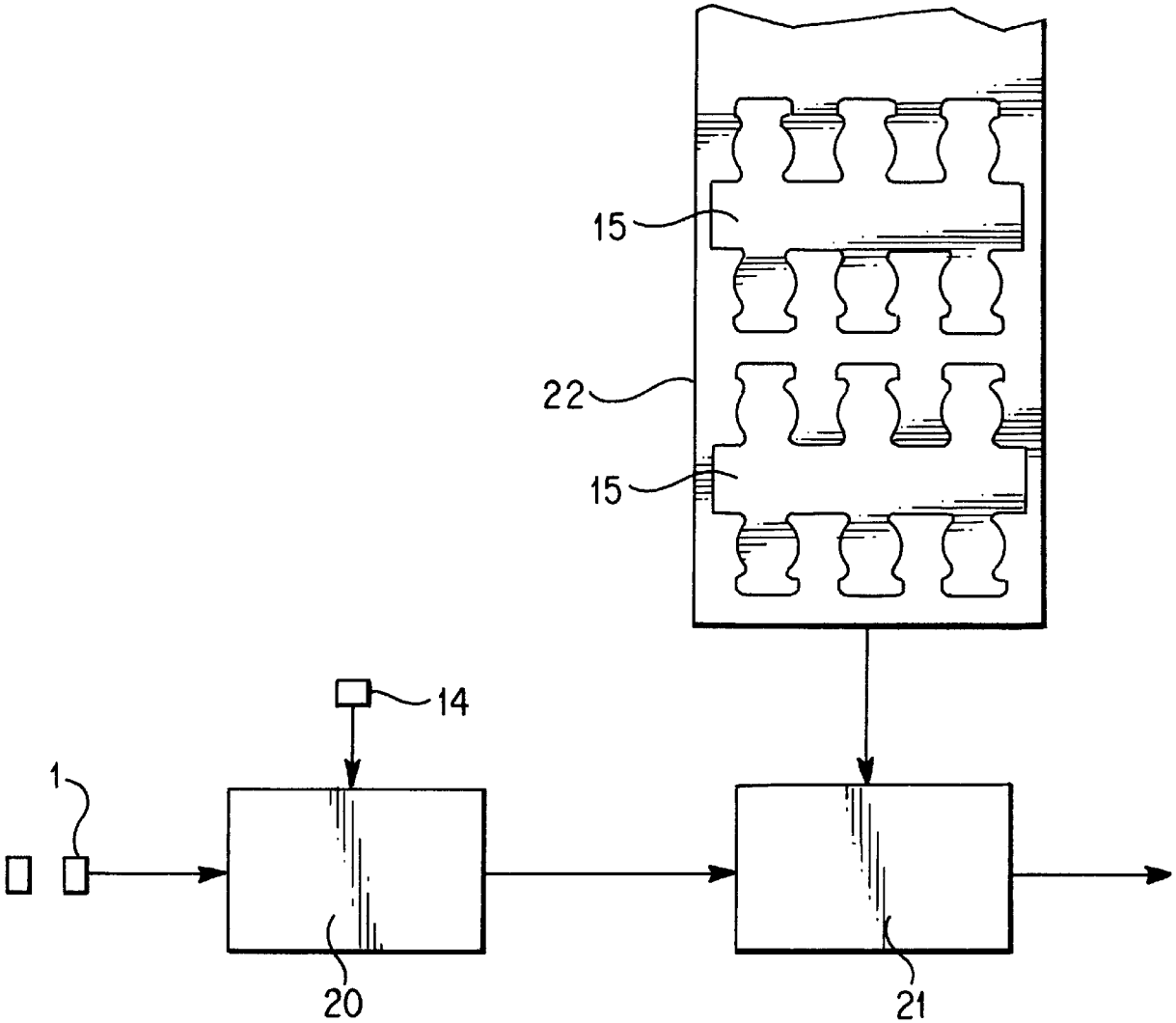
FIG. 6 shows schematically an apparatus for performing the packaging process.

The described package can be produced by the following process. The moulded containers 1 are fed to an automated filling machine 20 (FIG. 6) which is also supplied with batteries 14. The filling machine simultaneously fills the pockets 12 of the container base by loading respective batteries 14 into the pockets 12, the batteries all having their surfaces with the air holes uppermost. The containers with batteries loaded therein are delivered in turn to an automated labelling machine 21 which applies the sheet element 15 onto the container base 2 and batteries 14 so that it covers and is adhesively secured to the upper surfaces of the rail 11 and the batteries. The sheet elements 15 are supplied to the labelling machine as a strip, e.g. supplied from a roll, the strip including a backing web 22 on which the elements 15 are carried and to which they are removably attached by the same adhesive used to secure the elements to the container base and the batteries. The labelling machine removes individual elements from the backing web before labelling machine removes individual elements from the backing web before applying them.

While it is apparent that modifications and changes can be made within the spirit and scope of the present invention, it is our intention however, only to be limited by the appended claims.

We claim:

1. A package comprising:

a base with a plurality of pockets, adapted to receive articles therein; and a unitary element of flexible sheet material including a spine portion adhered to said base, article covering portions comprising a portion of said flexible sheet connected to the spine portion and extending over the respective pockets, the covering portions being adhesively connected to the articles received in the pockets and being stripable from said articles;

a cover over said covering portions of said flexible sheet, said cover being non-adhering to said covering portions of said flexible sheet and removable therefrom.

2. A package of batteries comprising:

a container including a base with a plurality of pockets; and a removable cover movable relative to the base to open and close the container;

a plurality of batteries received in respective pockets;

a unitary element of flexible sheet material including a spine portion adhered to the base, battery covering portions comprising a portion of said flexible sheet connected to the spine portion and extending over the respective pockets, and said removable cover covering said covering portions of said flexible sheet, said cover being non-adhering to said covering portions of said flexible sheet and removable therefrom, the covering portions being adhesively connected to the batteries received in the pockets and being stripable from said batteries.

3. A package according to claim 2, wherein the covering portions are arranged in opposed pairs extending from opposite sides of the spine portion.

4. A package according to claim 3, wherein each covering portion includes a tab projecting therefrom in the direction away from the spine portion.

5. A method of packaging articles comprising the steps of:

(i) providing a base having a plurality of separate pockets for accommodating respective articles;

(ii) loading articles into the pockets by means of an automated filling machine; and (iii) applying a unitary element of flexible sheet material over the base and the articles loaded into the pockets by means of an automated labelling machine, the element including a portion adhesively attached to the base, and article covering portions adhesively attached to the respective articles.

6. A method of packaging batteries comprising the steps of:

(i) providing a base having a plurality of pockets for accommodating respective batteries;

(ii) simultaneously loading batteries into the pockets; and (iii) applying a unitary element of flexible sheet material over the base and batteries loaded into the pockets, the element being applied by an automated labelling machine, and the element including a portion adhesively attached to the base, and battery covering portions adhesively attached to the respective batteries.

7. A method according to claim 5 or 6, wherein the automated labelling machine is supplied with a series of flexible elements carried on a backing web.

* * * * *